US012692629B2

(12) United States Patent
Lee et al.

(10) Patent No.: US 12,692,629 B2
(45) **Date of Patent: *Jul. 28, 2026**

(54) HIGH-STRENGTH POLYETHYLENE YARN HAVING AN IMPROVED SHRINKAGE RATE AND METHOD FOR MANUFACTURING THE SAME

(71) Applicant: KOLON INDUSTRIES, INC., Seoul (KR)

(72) Inventors: Sinho Lee, Seoul (KR); Young Soo Lee, Seoul (KR); Seong-Young Kim, Seoul (KR); Jung Eun Park, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 357 days.

This patent is subject to a terminal disclaimer.

(21) Appl. No.: 18/248,390

(22) PCT Filed: Oct. 8, 2021

(86) PCT No.: PCT/KR2021/013883
§ 371 (c)(1),
(2) Date: Apr. 10, 2023

(87) PCT Pub. No.: WO2022/075803
PCT Pub. Date: Apr. 14, 2022

(65) Prior Publication Data

US 2023/0392296 A1 Dec. 7, 2023

(30) Foreign Application Priority Data

Oct. 8, 2020 (KR) ..... 10-2020-0130274

(51) Int. Cl.
*D01F 8/06* (2006.01)
*D01D 5/088* (2006.01)
(Continued)

(52) U.S. Cl.
CPC ..... *D01F 8/06* (2013.01); *D01D 5/088* (2013.01); *D01D 5/098* (2013.01); *D01D 5/16* (2013.01);
(Continued)

(58) Field of Classification Search
None
See application file for complete search history.

(56) References Cited

U.S. PATENT DOCUMENTS 4,268,470 A 5/1981 Capaccio
4,525,564 A 6/1985 Capaccio
(Continued)

FOREIGN PATENT DOCUMENTS

CN 101094941 A 12/2007
CN 110820058 A 2/2020
(Continued)

OTHER PUBLICATIONS

Office Action From Japanese Patent Office Dated Oct. 28, 2025.
Extended European Search Report Dated Feb. 13, 2026, issued for European Patent Application No. 21878053.4.

*Primary Examiner* — Arti Singh-Pandey
(74) *Attorney, Agent, or Firm* — Harvest IP Law, LLP

(57) ABSTRACT

Provided are a high-strength polyethylene yarn having an improved shrinkage rate and a method for manufacturing the same. More particularly, a high-strength polyethylene yarn which has a specific microstructure and has an improved shrinkage rate to allow manufacture of high-density fabric, and a method for manufacturing the same are provided.

13 Claims, 2 Drawing Sheets

(51) Int. Cl.
*D01D 5/098* (2006.01)
*D01D 5/16* (2006.01)

(52) U.S. Cl.
CPC ..... *D10B 2321/0211* (2013.01); *D10B 2401/063* (2013.01)

(56) References Cited

U.S. PATENT DOCUMENTS

| | | | | |
|---|---|---|---|---|
| 4,647,640 | A | 3/1987 | Capaccio | |
| 7,736,564 | B2 | 6/2010 | Sakamoto | |
| 2006/0099415 | A1 | 5/2006 | Morin | |
| 2006/0210795 | A1 | 9/2006 | Morin | |
| 2006/0210796 | A1 | 9/2006 | Morin | |
| 2010/0173156 | A1 | 7/2010 | Morin | |
| 2012/0204322 | A1 | 8/2012 | Fukushima | |
| 2013/0029552 | A1 | 1/2013 | Fukushima | |
| 2013/0065052 | A1 | 3/2013 | Morin | |
| 2013/0302608 | A1 | 11/2013 | Morin | |
| 2023/0357965 | A1* | 11/2023 | Lee | D02G 3/02 |
| 2023/0357966 | A1* | 11/2023 | Lee | D01F 6/04 |
| 2025/0011976 | A1* | 1/2025 | Lee | D02J 1/22 |
| 2025/0034760 | A1* | 1/2025 | Lee | D03D 15/283 |

FOREIGN PATENT DOCUMENTS

| | | | |
|---|---|---|---|
| JP | H 02-182431 | A | 7/1990 |
| JP | H 07-003524 | A | 1/1995 |
| JP | 2004-019049 | A | 1/2004 |
| JP | 2010501740 | A | 1/2010 |
| JP | 2011-168926 | A | 9/2011 |
| JP | 2014001087 | A | 1/2014 |
| JP | 2015-071840 | A | 4/2015 |
| KR | 10-2016-0059653 | A | 5/2016 |
| KR | 101954356 | A | 3/2019 |
| KR | 10-2092934 | B1 | 3/2020 |
| KR | 102092934 | A | 3/2020 |
| KR | 20200036171 | A | 4/2020 |
| TW | 200622047 | A | 7/2006 |
| WO | 2008-154304 | A2 | 12/2008 |
| WO | 2009-105926 | A1 | 9/2009 |
| WO | 2011-049026 | A1 | 4/2011 |
| WO | 2012039188 | A1 | 3/2012 |
| WO | 2012117596 | A1 | 9/2012 |
| WO | 2020-052360 | A1 | 3/2020 |
| WO | 2020-138971 | A1 | 7/2020 |

* cited by examiner

[FIG. 1]
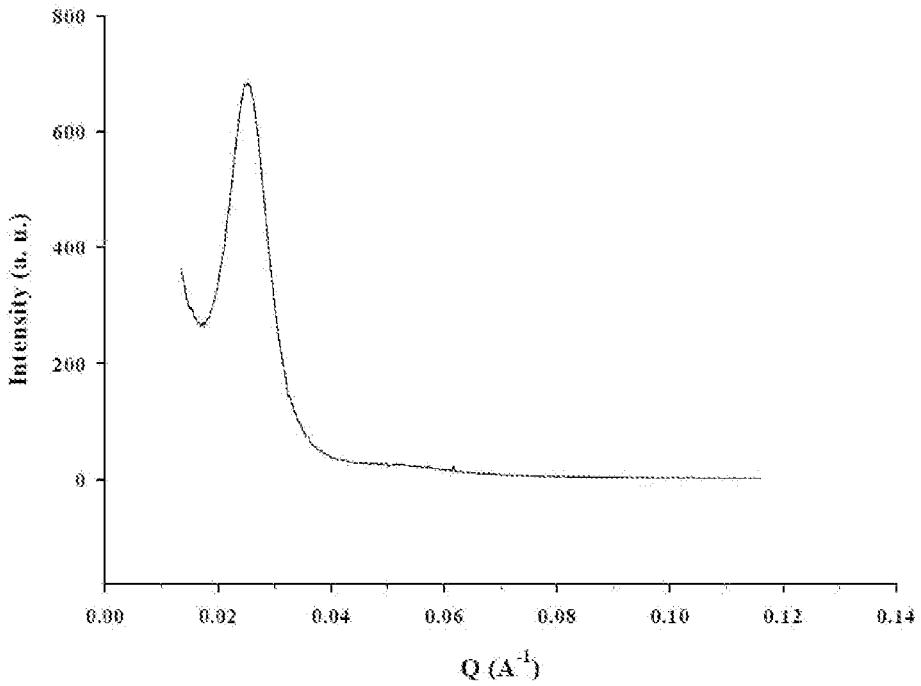
[FIG. 2]
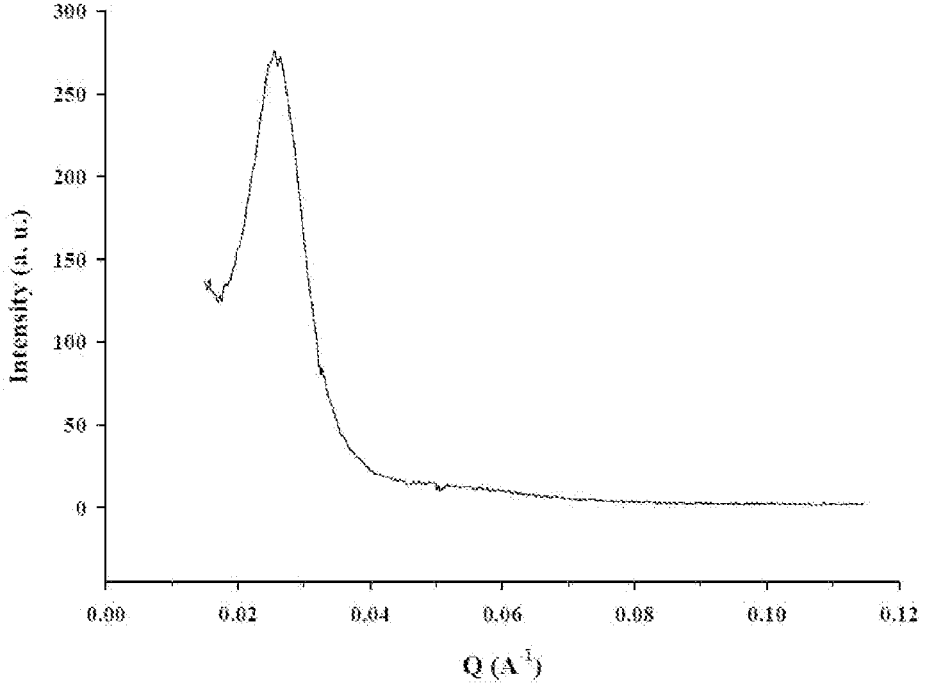

[FIG. 3]
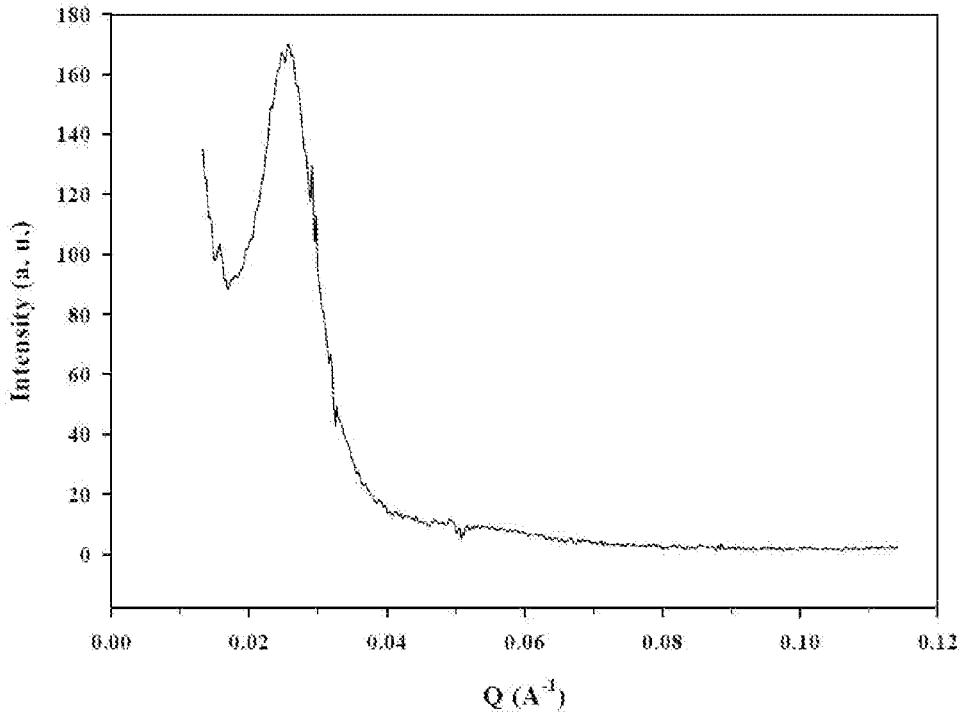
[FIG. 4]
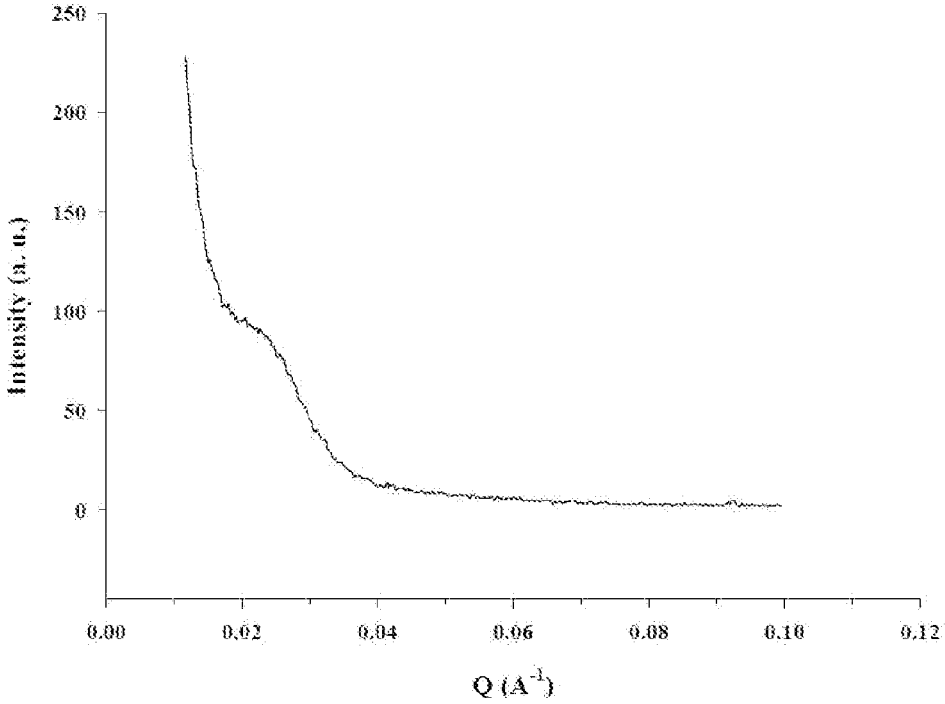

HIGH-STRENGTH POLYETHYLENE YARN HAVING AN IMPROVED SHRINKAGE RATE AND METHOD FOR MANUFACTURING THE SAME

CROSS REFERENCE TO RELATED APPLICATION(S)

This application is a National Stage of International Application No. PCT/KR2021/013883 filed Oct. 8, 2021, claiming priority based on Korean Patent Application No. 10-2020-0130274 filed Oct. 8, 2020, the disclosures of which are incorporated herein by reference in their entireties.

TECHNICAL FIELD

The present invention relates to a high-strength polyethylene yarn having an improved shrinkage rate and a method for manufacturing the same. More particularly, the present invention relates to a high-strength polyethylene yarn which has a specific microstructure and has an improved shrinkage rate to allow manufacture of high-density fabric, and a method for manufacturing the same.

BACKGROUND ART

Not only those who work in the field of security, such as police and soldiers, but also those who handle sharp cutting tools in various industrial fields are always exposed to the risk of injury. In order to minimize the risk of injury, protective products such as gloves or clothing should be provided.

The protective products are required to have cut resistance for appropriately protecting the human body from deadly weapons such as knives or sharp cutting tools.

In order to provide the protective product with high cut resistance, a high-strength polyethylene yarn is used in the manufacture of the protective product. For example, the high-strength polyethylene yarn is used alone in the manufacture of fabric or the high-strength polyethylene yarn and other kinds of yarn(s) form a plied yarn together, and then, the plied yarn may be used in the manufacture of fabric.

As a kind of high-strength polyethylene yarn, in order to solve an environmental problem due to the use of a gel spinning organic solvent using ultra-high molecular weight polyethylene (UHMWPE), a melt-spinning yarn using high-density polyethylene having a lower weight average molecular weight is being developed.

High-density polyethylene polymer has very few molecular chains having short or long branches, unlike other polymers. Due to the influence of the branch chains, most of the melt-spun high-strength polyethylene yarn using the high-density polyethylene has a high crystallinity and a low shrinkage rate. When the shrinkage rate is low, the weaving and knitting density of the product may be determined only in a weaving and knitting process to manufacture a finished product using yarn. In addition, it is impossible to manufacture high-density fabric having a higher density than the density determined in the weaving and knitting density.

DISCLOSURE

Technical Problem

An object of the present invention is to provide a high-strength polyethylene yarn having an improved shrinkage rate, and a method for manufacturing the same.

Another object of the present invention is to provide a polyethylene yarn which allows manufacture of fabric having high cut resistance and providing an excellent wearing sensation, and a method for manufacturing the same.

Still another object of the present invention is to provide a high-strength polyethylene yarn which may provide fabric having a higher surface density than a surface density adjustable in the conventional weaving and knitting process, and a method for manufacturing the same.

Technical Solution

The inventors of the present invention conducted studies for achieving the above objects, and as a result, found that a polyethylene yarn having a specific microstructure is manufactured to express high strength physical properties while improving the shrinkage rate of yarn, thereby completing the present invention.

In addition, the inventors found that the polyethylene yarn having an improved shrinkage rate is used to perform weaving and knitting, so that a higher density fabric may be provided, and also, a fabric providing excellent wearing sensation while having high cut resistance may be manufactured, thereby completing the present invention.

The polyethylene yarn having the specific microstructure means a yarn in which the scattering vector in small-angle X-ray scattering (SAXS) described later in detail satisfies a specific range, and it was found that the physical properties to be desired may be satisfied from the yarn satisfying the specific microstructure.

In addition, in the present invention, when a yarn in which the scattering vector in small-angle X-ray scattering (SAXS) described later satisfies a specific range may be manufactured, though the means is not limited, as an example, the yarn may be manufactured by adjusting a molecular weight distribution of a polyethylene resin, and a spinning temperature, a drawing ratio, and a drawing temperature during manufacture of yarn to a specific range, and the present invention is not limited thereto as long as the scattering vector in small-angle X-ray scattering (SAXS) satisfies the range described later.

In one general aspect, a polyethylene yarn having a ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) of 16 or more and a shrinkage rate of 2.5% or more, is provided.

In an exemplary embodiment, the yarn may have a melt index (MI) of 0.3 to 6 g/10 min as measured at 190° C. and 2.16 kg and a molecular weight distribution of more than 5 and less than 9.

In an exemplary embodiment, the yarn may have a crystallinity of 65 to 85%.

In an exemplary embodiment, the yarn may have a melting temperature of 130 to 140° C.

In an exemplary embodiment, the yarn may have a density of 0.93 to 0.97 g/cm$^3$.

In another general aspect, a method for manufacturing a polyethylene yarn includes:

melting polyethylene chips having a melt index (MI) of 0.3 to 6 g/10 min as measured at 190° C. and 2.16 kg and a molecular weight distribution of more than 5 and less than 9 to obtain a polyethylene melt;

spinning the polyethylene melt through a spinneret having a plurality of nozzle holes;

cooling a plurality of filaments which are formed when the polyethylene melt is discharged from the nozzle holes;

interlacing the plurality of filaments cooled to form a multifilament yarn;

drawing and heat-fixing the multifilament yarn at a total drawing ratio of 5 times to 20 times; and winding up the drawn and heat-fixed multifilament yarn, wherein the polyethylene yarn has a ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) of 16 or more and a shrinkage rate of 2.5% or more.

In an exemplary embodiment, a spinning temperature of the polyethylene melt may be 220 to 300° C.

In an exemplary embodiment, a highest drawing temperature in the drawing may be 100 to 150° C.

In an exemplary embodiment, the drawing step may be performed in multi-stage drawing.

In an exemplary embodiment, the drawing step may be performed using a plurality of godet rollers.

In an exemplary embodiment, the drawing step may be performed in multi-stage drawing of 4 stages or more and 20 stages or less.

In an exemplary embodiment, the plurality of godet rollers may be set to a temperature of 50 to 150° C., wherein a temperature of a first godet roller among the plurality of godet rollers is 50 to 80° C., a temperature of a last godet roller among the plurality of godet rollers is 100 to 150° C., and each temperature of godet rollers other than the first and last godet rollers among the plurality of godet rollers is equivalent to or higher than a temperature of a godet roller positioned at the immediately preceding stage.

Advantageous Effects

The polyethylene yarn according to the present invention has a specific microstructure, and thus, a polyethylene yarn having both high strength and improved shrinkage rate may be provided.

In addition, a fabric such as woven or knitted fabric manufactured from the polyethylene yarn may provide a higher density fabric than a fabric manufactured using a conventional high-strength polyethylene yarn.

In addition, though the polyethylene yarn according to the present invention is manufactured by melt spinning, it has high strength, so that it may be applied to a protective product having excellent cut resistance.

DESCRIPTION OF DRAWINGS

FIG. 1 is a small-angle X-ray scattering (SAXS) graph of the yarn according to Example 1.

FIG. 2 is a small-angle X-ray scattering (SAXS) graph of the yarn according to Example 2.

FIG. 3 is a small-angle X-ray scattering (SAXS) graph of the yarn according to Example 3.

FIG. 4 is a small-angle X-ray scattering (SAXS) graph of the yarn according to Comparative Example 1.

BEST MODEL

Hereinafter, the present invention will be described in more detail.

Unless otherwise defined, all technical terms and scientific terms have the same meanings as those commonly understood by one of those skilled in the art to which the present invention pertains. The terms used herein are only for effectively describing a certain specific example, and are not intended to limit the present invention.

In addition, the singular form used in the specification and claims appended thereto may be intended to also include a plural form, unless otherwise indicated in the context.

In addition, unless particularly described to the contrary, "comprising" any elements will be understood to imply further inclusion of other elements rather than the exclusion of any other elements.

The inventors of the present invention conducted studies for providing a high-strength polyethylene yarn which has high strength and also may achieve a high shrinkage rate. As a result, they found that the physical properties may be achieved from a polyethylene yarn having a specific microcrystalline structure.

Specifically, an embodiment of the present invention relates to a polyethylene yarn having a ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) of 16 or more and a shrinkage rate of 2.5% or more. It was found that within the range satisfying both the A/B in small-angle X-ray scattering (SAXS) and the shrinkage rate, the yarn has both high strength and high shrinkage rate as desired, so that a high-density fabric may be manufactured, thereby completing the present invention.

The A/B in small-angle X-ray scattering (SAXS) may be 16 or more, preferably 18 or more, and more preferably 20 or more and 40 or less. Specifically, for example, A/B may be 16 to 35. A specific microcrystalline structure is formed within the range, and thus, a yarn satisfying a shrinkage rate of 2.5% or more, more preferably 3% or more, 3.5% or more, 4% or more, and specifically 2.5 to 10% may be provided. The shrinkage rate refers to a dry heat shrinkage rate at 100° C. Simultaneously, a high-strength yarn may be provided.

The manufacturing method is not limited in the present invention, as long as a yarn satisfying both physical properties of the A/B in small-angle X-ray scattering (SAXS) of 16 or more and the shrinkage rate of 2.5% or more may be manufactured, but, as an example, the yarn may be manufactured by adjusting the molecular weight distribution of a polyethylene resin, and the spinning temperature, the drawing ratio, and the drawing temperature in manufacture of yarn to specific ranges.

More specifically, for example, the yarn is manufactured using a polyethylene resin having a molecular weight distribution of more than 5 and less than 9, the spinning temperature may be 220 to 300° C., the drawing ratio may be 5 times to 20 times, and the drawing temperature may be 100 to 150° C. However, the conditions are for an illustration, and are not limited thereto. The present invention may be carried out by changing various conditions in the common technical art, and the conditions are only for illustrating or describing the present invention, but do not limit the right scope of the present invention.

Hereinafter, configurations of the present invention will be described in detail.

In an exemplary embodiment of the present invention, a polyethylene resin used as a raw material means that the repeating unit is substantially ethylene, and a copolymer with a small amount of other monomers, for example, α-olefin, acrylic acid and the derivative thereof, methacrylic acid and the derivative thereof, vinylsilane and the derivative thereof, and the like is also preferred. In addition, a blend of the copolymers with an ethylene homopolymer or a copolymer of other α-olefins and the like is also possible.

More preferably, it may be more advantageous for providing the yarn having a high shrinkage rate of the present invention to include a short chain or a branch of a long chain to some extent by using a copolymer with α-olefin such as ethylene, propylene, and butene-1, and even an ethylene homopolymer may be used as long as it satisfies the physical properties of the present invention.

The polyethylene resin may have a weight average molecular weight of 600,000 g/mol or less, and more specifically 80,000 to 600,000 g/mol, in terms of allowing melt spinning.

In an exemplary embodiment of the present invention, the polyethylene yarn may have a molecular weight distribution of more than 5 and less than 9, more preferably 6 to 8, and more preferably 6.5 to 7.5. The molecular weight distribution is a ratio (Mw/Mn) of a weight distribution index (Mw) to a number average molecular weight (Mn), and may be also referred to as a polydispersity index or molecular weight distribution index (MWD). In addition, a melt index (MI) measured at 190° C. and 2.16 kg may be 0.3 to 6 g/10 min, and more preferably 0.4 to 3 g/10 min.

Within the range satisfying all of the physical properties, processability is secured, for example, the flowability of a melt in melt extrusion of yarn is good, occurrence of thermal decomposition is prevented, and breakage during spinning does not occur, thereby providing a yarn having uniform physical properties, and providing a yarn having both high strength and a shrinkage rate of 2.5% or more to be desired.

In addition, high-density polyethylene (HDPE) satisfying ranges of a density of 0.93 to 0.97 g/cm$^3$, more preferably 0.941 to 0.965 g/cm$^3$ and a molecular weight distribution of more than 5 and less than 9 is used, thereby obtaining a fiber having a crystallinity of 65 to 85%, more preferably 70 to 80% by melt spinning. The crystallinity of the polyethylene yarn may be derived with a microcrystalline size in crystallinity analysis using an X-ray scatter analyzer.

In an exemplary embodiment, the cross-sectional shape of the yarn is not limited, but the yarn may have a circular cross section, or may be twisted.

In an exemplary embodiment, the polyethylene yarn of the present invention may be a multifilament yarn of 40 to 500 continuous filaments. Each of the continuous filaments may have a fineness of 1 to 3 deniers, and the polyethylene yarn may have a total fineness of 100 to 1,000 definers. Within the range, the fabric is light and fabric having excellent durability may be provided.

Hereinafter, the method for manufacturing a polyethylene yarn according to an embodiment of the present invention will be described in detail. The manufacturing method is not limited as long as the polyethylene yarn of the present invention satisfies the physical properties of a ratio (A/B) of a highest intensity peak (A) occurring at a scattering vector of 0 to 0.04 Å$^{-1}$ to a highest intensity peak (B) occurring at a scattering vector of 0.05 to 0.08 Å$^{-1}$ in small-angle X-ray scattering (SAXS) of 16 or more and a shrinkage rate of 2.5% or more, and the following illustrates one exemplary embodiment.

The method for manufacturing a yarn according to the present invention may include:

melting polyethylene chips having a melt index (MI) of 0.3 to 6 g/10 min as measured at 190° C. and 2.16 kg and a molecular weight distribution of more than 5 and less than 9 to obtain a polyethylene melt;

spinning the polyethylene melt through a spinneret having a plurality of nozzle holes;

cooling a plurality of filaments which are formed when the polyethylene melt is discharged from the nozzle holes;

interlacing the plurality of filaments cooled to form a multifilament yarn;

drawing and heat-fixing the multifilament yarn at a total drawing ratio of 5 times to 20 times; and winding up the drawn and heat-fixed multifilament yarn.

The details of each step are described. First, polyethylene in the form of chips is introduced into an extruder 100 and melted to obtain a polyethylene melt.

The polyethylene chips may have a polydispersity index (PDI) of more than 5 and less than 9. In addition, the polyethylene chips have a melt index (MI) of 0.3 to 6 g/10 min. In addition, the polyethylene chips may have a weight average molecular weight (Mw) of 600,000 g/mol or less, more specifically 80,000 to 600,000 g/mol, preferably 100,000 to 500,000 g/mol, and more preferably 200,000 to 400,000 g/mol. Within the range of weight average molecular weight (Mw), a high-strength yarn may be manufactured, and specifically, a yarn having a tensile strength of 10 g/d or more may be manufactured. When the weight average molecular weight (Mw) is too high, which is more than 600,000 g/mol, overloading is applied to a spinning device due to a high melt viscosity and process controlling is not appropriately performed, so that it is difficult to secure excellent physical properties of a yarn. Therefore, the polyethylene chips may have a weight average molecular weight (Mw) of 600,000 g/mol or less, more specifically 80,000 to 600,000 g/mol, preferably 100,000 to 500,000 g/mol, and more preferably 200,000 to 400,000 g/mol.

The molten polyethylene is transported through a spinneret by a screw in the extruder and is extruded through a plurality of holes formed on the spinneret. The number of holes of the spinneret may be determined depending on the denier per filament (DPF) and the fineness of the yarn to be manufactured. For example, when a yarn having a total fineness of 75 deniers is manufactured, the spinneret may have 20 to 75 holes, and when a yarn having a total fineness of 450 deniers is manufactured, the spinneret may have 90 to 450, preferably 100 to 400 holes.

A melting process in the extruder and an extrusion process by the spinneret may be changed depending on the melt index of the polyethylene chips, but specifically, for example, may be performed at 150 to 315° C., preferably 220 to 300° C., and more preferably 250 to 290° C. That is, it is preferred that the extruder and the spinneret may be maintained at 150 to 315° C., preferably 220 to 300° C., and more preferably 250 to 290° C.

When the spinning temperature is lower than 150° C., polyethylene does not melt uniformly due to the low spinning temperature, so that the spinning may be difficult. However, the spinning temperature is higher than 315° C., thermal decomposition of polyethylene is caused, so that a desired strength may not be expressed.

A ratio (L/D) of a hole length (L) to a hole diameter (D) of the spinneret may be 3 to 40. When L/D is less than 3, die swell occurs during melt extrusion and it becomes hard to control the elastic behavior of polyethylene to deteriorate spinning properties, and when L/D is more than 40, breakage due to necking of melt polyethylene passing through a spinneret and discharge non-uniformity due to pressure drop may occur.

As the melt polyethylene discharges from holes of the spinneret, solidification of polyethylene starts due to a difference between a spinning temperature and room temperature to form filaments in a semi-solidified state. In the present specification, not only the filaments in a semi-solidified state but also completely solidified filaments are collectively referred to as "filaments".

The plurality of filaments is cooled in a cooling part (or "quenching zone") to be completely solidified. The filaments may be cooled in an air cooling manner.

It is preferred that the filaments may be cooled in the cooling part using a cooling air at a wind speed of 0.2 to 1 m/sec so that the filaments are cooled to 15 to 40° C. When the cooling temperature is lower than 15° C., elongation is insufficient due to supercooling so that breakage may occur in a drawing process, and when the cooling temperature is higher than 40° C., a fineness deviation between filaments is increased due to solidification unevenness and breakage may occur in a drawing process.

In addition, by performing multi-stage cooling in cooling in a cooling part, crystallization may be more uniform.

More specifically, the cooling part may be divided into three or more sections. For example, when the cooling part is composed of three cooling sections, it is preferred to design the cooling part so that the temperature is gradually lowered from a first cooling part to a third cooling part. Specifically, for example, the first cooling part may be set at 40 to 80° C., the second cooling part may be set at 30 to 50° C., and the third cooling part may be set at 15 to 30° C.

In addition, by setting a wind speed highest in the first cooling part, a fiber having a smoother surface may be manufactured. Specifically, the cooling part may be set so that the first cooling part is cooled to 40 to 80° C. using a cooling wind at a wind speed of 0.8 to 1 m/sec, the second cooling part is cooled to 30 to 50° C. using a cooling wind at a wind speed of 0.4 to 0.6 m/sec, and the third cooling part is cooled to 15 to 30° C. using a cooling wind at a wind speed of 0.2 to 0.5 m/sec, and by adjusting the cooling part as described above, a yarn having more high crystallinity and a smoother surface may be manufactured.

Subsequently, the cooled and completely solidified filaments were sized by an interlacer to form a multifilament.

The polyethylene yarn of the present invention may be manufactured by a direct spinning drawing (DSD) process. That is, the multifilament is directly delivered to the multi-stage drawing part including a plurality of godet roller parts, and is multi-stage drawn to a total drawing ratio of 5 times to 20 times, preferably 8 times to 15 times and then wound on a winder.

As an example, it is preferred that a drawing step of using the plurality of godet rollers is performed by drawing in 4 or more multi-stages. Preferably, the drawing step may be performed by multi-stage drawing in 4 stages or more and 20 stages or less using a plurality of godet rollers. When the multi-stage drawing is performed in 4 stages or less, rapid drawing occurs in each section of the godet rollers, so that a fluff occurrence frequency is increased and an initial modulus is increased in the manufacture of filament yarn, resulting in excessive stiffness of fabric. In addition, in the multi-stage drawing, when the drawing is performed in 20 stages or more, friction between filament yarn and a godet roller is increased to cause filament damage and single yarn.

In addition, even in the case of using polyethylene chips having a polydispersity index (PDI) of more than 5 and less than 9 and a melt index (MI at 190° C.) of 0.3 to 6 g/10 min, when the drawing ratio, the drawing temperature, and the conditions of the number of stages according to the method of the present invention are not satisfied, the desired physical properties may not be satisfied. For example, in the drawing, a highest drawing temperature is preferably 100 to 150° C., a total drawing ratio is 5 times to 20 times, and multi-stage drawing in 4 stages or more may be performed. The highest drawing temperature is a highest temperature in a drawing section, and the total drawing ratio is a final drawing ratio of the fiber after the last drawing as compared with the fiber before drawing.

For example, the multi-stage drawing may be performed in 4 stages or more, more specifically 4 stages or more and 20 stages or less, using a plurality of godet rollers. Among the plurality of godet rollers (GR1, . . . GRn), the temperature of a first godet roller (GR1) may be 50 to 80° C., and the temperature of a last godet roller (GRn) may be 100 to 150° C. Each temperature of the remaining godet rollers other than the first and last godet roller parts (GR1 and GRn) may be set to be equivalent to or higher than the temperature of the godet roller in the immediately preceding stage. The temperature of the last godet roller part (GRn) may be set to be equivalent to or higher than the temperature of the godet roller part in the immediately preceding stage, but may be set to be somewhat lower than that.

In addition, in the last drawing section in the multi-stage drawing, shrinkage drawing (relaxation) at 1 to 5% may be imparted to provide a yarn having better durability.

More specifically, for example, the multi-stage drawing may be composed of a total of 4 stages of godet roller parts, and the first godet roller part may be set to be drawn to 2 to 4 times at 50 to 80° C., the second godet roller part may be set to be drawn to 3 to 10 times at 70 to 100° C., the third godet roller part may be set to be drawn to 1.1 to 3 times at 80 to 110° C., and the fourth godet roller part may be set to be shrunk and drawn (relaxed) at 1 to 5% at 100 to 150° C. The first to fourth godet roller parts may be composed of a plurality of godet rollers, respectively. Specifically, for example, the godet roller parts may be composed of two or more, more specifically two to 10 godet rollers.

Alternatively, the multifilament yarn is wound up once as an undrawn yarn, and then the undrawn yarn is drawn, thereby manufacturing the polyethylene yarn of the present invention. That is, the polyethylene yarn of the present invention may be manufactured by a two-step process in which polyethylene is melt-spun to manufacture an undrawn yarn once, and then the undrawn yarn is drawn.

When the total drawing ratio applied to the drawing process is less than 5, the finally obtained polyethylene yarn may not have a crystallinity of 65% or more, and the physical properties of A/B in small-angle X-ray scattering (SAXS) of 16 or more and the shrinkage rate of 2.5% or more may not be achieved. In addition, there is a risk of causing lint (peeling) on fabric manufactured by the yarn.

However, when the total drawing ratio is more than 20, breakage may occur, the strength of the finally obtained polyethylene yarn is not appropriate so that the weaving properties of the polyethylene yarn may not be good, and the fabric manufactured using the yarn is too stiff, so that a user may feel uncomfortable.

When a linear speed of the first godet roller part (GR1) which determines the spinning speed of the melt spinning of the present invention is determined, the linear speeds of the remaining godet roller parts are appropriately determined, so that a total drawing ratio of 5 to 20 times, preferably 8 to 15 times is applied to the multifilament in the multi-stage drawing part.

The multi-stage drawing and the heat fixation of the multifilament are simultaneously performed by the multi-stage drawing part, and the multi-stage drawn multifilament is wound on a winder, thereby completing the polyethylene yarn of the present invention.

The polyethylene yarn manufactured as described above may be used in the manufacture of protective products requiring excellent cut resistance (for example, protective gloves, underwear, bags, and the like).

Hereinafter, the present invention will be described in more detail with reference to the Examples and Comparative Examples. However, the following Examples and Comparative Examples are only an example for describing the present invention in more detail, and do not limit the present invention in any way.

The physical properties were measured as follows.

<Weight Average Molecular Weight (Mw) (g/Mol) and Polydispersity Index (PDI)>

A polyethylene yarn was completely dissolved in the following solvent and then each of the weight average molecular weight (Mw) and the polydispersity index (Mw/Mn: PDI) was determined using the following gel permeation chromatography (GPC).

Analysis instrument: HLC-8321 GPC/HT available from Tosoh Corporation

Column: PLgel guard (7.5×50 mm)+2×PLgel mixed-B (7.5×300 mm)

Column temperature: 160° C.

Solvent: trichlorobenzene (TCB)+0.04 wt % of dibutyl hydroxy toluene (BHT) (after drying with 0.1% CaCl2))

Injector and Detector temperature: 160° C.

Detector: RI Detector

Flow velocity: 1.0 ml/min

Injection amount: 300 mL

Sample concentration: 1.5 mg/mL

Standard sample: polystyrene

<Tensile Strength (g/d), Initial Modulus (g/d), and Elongation (%)>

According to the method of ASTM D2256, a universal tensile tester available from Instron (Instron Engineering Corp, Canton, Mass) was used to obtain a strain-stress curve of the polyethylene yarn. A sample length was 250 mm, a tensile speed was 300 mm/min, and an initial load was set to 0.05 g/d. The tensile strength (g/d) and the elongation (%) were obtained from the stress and the stretch at breaking, and the initial modulus (g/d) was determined from a tangent to impart a maximum gradient near the starting point of the curve. The measurement was performed five times for each yarn and the average value was calculated.

<Crystallinity of Yarn>

An XRD instrument (X-ray Diffractometer) [manufacturer: PANalytical, model name: EMPYREAN] was used to measure the crystallinity of the polyethylene yarn. Specifically, the polyethylene yarn was cut to prepare a sample having a length of 2.5 cm, the sample was fixed to a sample holder, and the measurement was performed under the following conditions:

Light source (X-ray Source): Cu-Kα radiation

Power: 45 KV×25 mA

Mode: continuous scan mode

Scan angle range: 10 to 40°

Scan speed: 0.1°/sec

<Melt Index>

Measurement was performed at 190° C. under 2.16 kg according to ASTM D 1238.

<Small-Angle X-Ray Scattering>

An XRD instrument (X-ray Diffractometer) [manufacturer: PANalytical, model name: EMPYREAN] was used to perform measurement.

From the measured graph, a ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ was calculated.

Light source (X-ray Source): Cu-Kα radiation

Power: 45 KV×40 mA

Mode: continuous scan mode

Scan angle range: 0.1 to 2.00

Scan speed: 0.01°/sec

<Shrinkage Rate>

A polyethylene yarn was cut to obtain a sample having a length of 70 cm, and the sample was marked at points 10 cm apart from both ends, respectively (that is, a distance between marked points=50 cm). Subsequently, the sample was heated at 100° C. for 30 minutes using a hot air circulation type heating furnace, in a state in which the sample was hung on a jig so that a load was not applied to the sample. Thereafter, the sample was taken out of the heating furnace and slowly cooled to room temperature, and then distances between the marked points were measured. Then, the following equation was used to calculate a dry heat shrinkage rate at 100° C. of the polyethylene yarn:

$$\text{Dry heat shrinkage rate (\%)}=[(10-11)/10]\times 100$$

wherein 10 is a distance between marked points before heating (that is, 50 cm), and 11 is a distance between marked points after heating.

The average value of the dry heat shrinkage rates obtained from two tests was determined.

Example 1

<Manufacture of Polyethylene Yarn>

A polyethylene yarn including 240 filaments and having a total fineness of 500 deniers was manufactured.

Specifically, polyethylene chips having a density of 0.962 g/cm$^3$, a weight average molecular weight (Mw) of 340,000 g/mol, a molecular weight distribution of 7.5, and a melt index (MI at 190° C.) of 1.8 g/10 min were introduced to an extruder and melted. The molten polyethylene was extruded through a spinneret having 240 holes. L/D which is a ratio of a hole length (L) to a hole diameter (D) of the spinneret was 6. A spinneret temperature was 260° C.

Filaments formed by discharge from the nozzle holes of the spinneret were sequentially cooled in a cooling part composed of three sections. In a first cooling part, the filaments were cooled to 50° C. by a cooling wind at a wind speed of 0.9 m/sec, in a second cooling part, the filaments were cooled to 35° C. by a cooling wind at a wind speed of 0.5 m/sec, and in a third cooling part, the filaments were finally cooled to 25° C. by a cooling wind at a wind speed of 0.4 m/sec. After cooling, the filaments were sized to a multifilament yarn by an interlacer.

Subsequently, the multifilament yarn was transported to a drawing part. The drawing part was composed of a multistage drawing part composed of 4 sections and was composed of a total of 4 stages of godet roller parts, and each godet roller part was composed of 2 to 10 godet rollers. A first godet roller part was set to have a highest temperature of 80° C., a second godet roller part was set to have a highest temperature of 90° C., a third godet roller part was set to have a highest temperature of 95° C., and a fourth godet roller part was set to have a highest temperature of 120° C., and a drawing ratio was set to be drawn to twice in the first godet roller part, drawn to three times in the second godet roller part, drawn to 1.4 times in the third godet roller, and shrunk and drawn (relaxed) at 4% in the fourth godet roller part as compared with the third godet roller part, and thus, drawing and heat fixation were performed at a total drawing ratio of 8 times.

Subsequently, the drawn multifilament yarn was wound on a winder. A winding tension was 0.8 g/d.

The physical properties of the thus-manufactured yarn were measured, and are shown in the following Table 1. In addition, small-angle X-ray scattering (SAXS) was measured and is shown in FIG. 1. A ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) was 28.

Example 2

<Manufacture of Polyethylene Yarn>

A yarn was manufactured in the same manner as in Example 1, except that the total drawing ratio was adjusted to 11 times.

The physical properties of the thus-manufactured yarn were measured, and are shown in the following Table 1. In addition, small-angle X-ray scattering (SAXS) was measured and is shown in FIG. 2. A ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) was 27.5.

Example 3

<Manufacture of Polyethylene Yarn>

A yarn was manufactured in the same manner as in Example 1, except that the total drawing ratio was adjusted to 13 times.

The physical properties of the thus-manufactured yarn were measured, and are shown in the following Table 1. In addition, small-angle X-ray scattering (SAXS) was measured and is shown in FIG. 3. A ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) was 22.6.

Example 4

<Manufacture of Polyethylene Yarn>

A yarn was manufactured in the same manner as in Example 1, except that polyethylene chips having a density of 0.961 g/$cm^3$, a weight average molecular weight (Mw) of 340,000 g/mol, a molecular weight distribution of 5.5, and a melt index (MI at 190° C.) of 1.7 g/10 min were used, and the total drawing ratio was adjusted to 13 times.

The physical properties of the thus-manufactured yarn were measured, and are shown in the following Table 1. A ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) was 16.

Example 5

<Manufacture of Polyethylene Yarn>

A yarn was manufactured in the same manner as in Example 1, except that polyethylene chips having a density of 0.961 g/$cm^3$, a weight average molecular weight (Mw) of 340,000 g/mol, a molecular weight distribution of 8, and a melt index (MI at 190° C.) of 1.6 g/10 min were used, and the total drawing ratio was adjusted to 13 times.

The physical properties of the thus-manufactured yarn were measured, and are shown in the following Table 1. A ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) was 18.

Comparative Example 1

<Manufacture of Polyethylene Yarn>

A yarn was manufactured in the same manner as in Example 1, except that polyethylene chips having a density of 0.960 g/$cm^3$, a weight average molecular weight (Mw) of 340,000 g/mol, a molecular weight distribution of 3, and a melt index (MI at 190° C.) of 1.5 g/10 min were used, and the total drawing ratio was adjusted to 11 times.

The physical properties of the thus-manufactured yarn were measured, and are shown in the following Table 1. In addition, small-angle X-ray scattering (SAXS) was measured and is shown in FIG. 4. A ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) was 15.

TABLE 1

| | Example 1 | Example 2 | Example 3 | Example 4 | Example 5 | Comparative Example 1 |
|---|---|---|---|---|---|---|
| MI of PE yarn (g/10 min) | 3.2 | 3.1 | 2.9 | 3.1 | 3.3 | 3.1 |
| PDI of PE yarn | 7.5 | 7.5 | 7.5 | 5.5 | 8 | 3 |
| Highest spinning temperature (° C.) | 260 | 260 | 260 | 260 | 260 | 260 |
| Total drawing ratio (times) | 8 | 11 | 13 | 13 | 13 | 11 |
| Highest drawing temperature (° C.) | 120 | 120 | 120 | 120 | 120 | 120 |
| A/B | 32 | 27.5 | 22.6 | 18 | 28 | 15 |
| Mw (g/mol) | 312000 | 314000 | 311000 | 311000 | 315000 | 305000 |
| Shrinkage rate (%) | 4.6 | 3.4 | 2.5 | 2.5 | 2.9 | 1.5 |
| Crystallinity (%) | 75 | 80 | 83 | 79 | 77 | 80 |
| Tensile strength (g/d) | 10.4 | 13.5 | 14.1 | 14.2 | 13.8 | 14.1 |

TABLE 1-continued

| | Example 1 | Example 2 | Example 3 | Example 4 | Example 5 | Comparative Example 1 |
|---|---|---|---|---|---|---|
| Initial modulus (g/d) | 101 | 198 | 233 | 248 | 253 | 410 |
| Elongation (%) | 11.9 | 9.0 | 8.1 | 7.4 | 8.9 | 7.0 |
| Melting temperature (° C.) | 135 | 136 | 137 | 136 | 137 | 136 |

Hereinabove, although the present invention has been described by specific matters, limited exemplary embodiments, and drawings, they have been provided only for assisting the entire understanding of the present invention, and the present invention is not limited to the exemplary embodiments, and various modifications and changes may be made by those skilled in the art to which the present invention pertains from the description.

Therefore, the spirit of the present invention should not be limited to the above-described exemplary embodiments, and the following claims as well as all modified equally or equivalently to the claims are intended to fall within the scope and spirit of the invention.

The invention claimed is:

1. A polyethylene yarn having a ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) of 16 or more and a shrinkage rate of 2.5% or more, and a weight average molecular weight (Mw) of 200,000 to 600,000 g/mol.

2. The polyethylene yarn of claim 1, wherein the yarn has a melt index (MI) of 0.3 to 6 g/10 min as measured at 190° C. and 2.16 kg.

3. The polyethylene yarn of claim 1, wherein the yarn has a molecular weight distribution of more than 5 and less than 9.

4. The polyethylene yarn of claim 1, wherein the yarn has a crystallinity of 65 to 85%.

5. The polyethylene yarn of claim 1, wherein the yarn has a melting temperature of 130 to 140° C.

6. The polyethylene yarn of claim 1, wherein the yarn has a density of 0.93 to 0.97 g/$cm^3$.

7. A method for manufacturing a polyethylene yarn, the method comprising:

melting polyethylene chips having a melt index (MI) of 0.3 to 6 g/10 min as measured at 190° C. and 2.16 kg, a molecular weight distribution of more than 5 and less than 9 and a weight average molecular weight (Mw) of 200,000 to 600,000 g/mol to obtain a polyethylene melt;

spinning the polyethylene melt through a spinneret having a plurality of nozzle holes;

cooling a plurality of filaments which are formed when the polyethylene melt is discharged from the nozzle holes;

interlacing the plurality of filaments cooled to form a multifilament yarn;

drawing and heat-fixing the multifilament yarn at a total drawing ratio of 5 times to 20 times; and winding up the drawn and heat-fixed multifilament yarn, wherein the polyethylene yarn has a ratio (A/B) of a highest intensity peak (A) occurring at a scattering vector of 0 to 0.04 $Å^{-1}$ to a highest intensity peak (B) occurring at a scattering vector of 0.05 to 0.08 $Å^{-1}$ in small-angle X-ray scattering (SAXS) of 16 or more and a shrinkage rate of 2.5% or more.

8. The method for manufacturing a polyethylene yarn of claim 7, wherein a spinning temperature of the polyethylene melt is 220 to 300° C.

9. The method for manufacturing a polyethylene yarn of claim 7, wherein a highest drawing temperature in the drawing is 100 to 150° C.

10. The method for manufacturing a polyethylene yarn of claim 7, wherein the drawing is performed as multi-stage drawing.

11. The method for manufacturing a polyethylene yarn of claim 10, wherein the multi-stage drawing is performed using a plurality of godet rollers.

12. The method for manufacturing a polyethylene yarn of claim 10, wherein the multi-stage drawing is performed in multi-stages of 4 stages or more and 20 stages or less.

13. The method for manufacturing a polyethylene yarn of claim 11, wherein the plurality of godet rollers is set to a temperature of 50 to 150° C., in which a temperature of a first godet roller among the plurality of godet rollers is 50 to 80° C., a temperature of a last godet roller among the plurality of godet roller parts is 100 to 150° C., and each temperature of godet rollers other than the first and last godet rollers among the plurality of godet rollers is equivalent to or higher than a temperature of a godet roller positioned at the immediately preceding stage.

* * * * *